United States Patent [19]

Frederick et al.

[11] Patent Number: 4,562,651

[45] Date of Patent: Jan. 7, 1986

[54] SOLE WITH V-ORIENTED FLEX GROOVES

[75] Inventors: Edward C. Frederick, Kingston; John R. Robinson, Newmarket, both of N.H.

[73] Assignee: Nike, Inc., Beaverton, Oreg.

[21] Appl. No.: 549,659

[22] Filed: Nov. 8, 1983

[51] Int. Cl.[4] ..... A43B 5/00; A43B 13/14; A43B 13/08

[52] U.S. Cl. ..... 36/102; 36/25 R; 36/59 C; 36/32 R; D2/320

[58] Field of Search ..... 36/25 R, 31, 32 R, 102, 36/103, 59 C; D2/309, 310, 320

[56] References Cited

U.S. PATENT DOCUMENTS

| | | | |
|---|---|---|---|
| D. 185,954 | 8/1959 | Powell | 36/25 R |
| 1,569,576 | 1/1926 | Raymond . | |
| 1,776,750 | 9/1930 | Burns . | |
| 2,211,057 | 8/1940 | Duckoff . | |
| 2,405,498 | 8/1946 | Gregg . | |
| 2,547,480 | 4/1951 | McDaniel . | |
| 3,290,803 | 2/1964 | Spatoza | 36/32 R |
| 3,724,106 | 4/1973 | Magidson | 36/44 |
| 3,818,617 | 6/1974 | Dassier et al. . | |
| 4,240,214 | 12/1980 | Sigle et al. | 36/43 |
| 4,262,435 | 4/1981 | Block et al. . | |
| 4,309,831 | 1/1982 | Pritt . | |
| 4,309,832 | 1/1982 | Hunt | 36/32 R |
| 4,364,190 | 12/1982 | Yonkers . | |

FOREIGN PATENT DOCUMENTS

| | | | |
|---|---|---|---|
| 1026200 | 3/1958 | Fed. Rep. of Germany | 36/32 R |

*Primary Examiner*—Henry S. Jaudon
*Assistant Examiner*—Steven N. Meyers
*Attorney, Agent, or Firm*—Banner, Birch, McKie & Beckett

[57] ABSTRACT

An improved sole for use with footwear is disclosed. The sole includes at least one layer of material which is adapted to be attached to an upper of the footwear. A distal flex groove is formed in the sole and is coextensive with a medial metatarsal-phalanges line which extends between the first and second metatarsal-phalanges joints. A proximal flex groove is also formed in the sole and extends substantially parallel to a lateral metatarsal-phalanges line which extends along the second through fifth metatarsal-phalanges joints. The proximal and distal grooves join on another at the medial edge of the sole adjacent the first metatarsal-phalanges joint.

23 Claims, 6 Drawing Figures

SOLE WITH V-ORIENTED FLEX GROOVES

TECHNICAL FIELD

The present invention relates to footwear, and in particular, to footwear with a sole having flex-grooves in a V-orientation. The sole is particularly useful in athletic shoes.

BACKGROUND OF THE INVENTION

The modern athletic shoe is a highly refined combination of many elements which have specific functions, all of which must work together for the support and protection of the foot during athletic activity and events. A shoe is divided into two general parts, an upper and a sole.

The upper is designed to snugly and comfortably enclose the foot. Typically, an upper of an athletic shoe will have several layers including a weather- and wear-resistant outer layer of leather or synthetic material such as nylon, and a soft, padded inner liner for foot comfort. Current athletic shoe uppers typically have an intermediate layer of a synthetic foam material. The three layers of the upper may be fastened together by stitching, cementing, or a combination of these. In areas of maximum wear or stress, reinforcements of leather and/or plastic are attached to the upper. Examples of such reinforcements are leather toe sections attached over synthetic inner layers of the toe area and heel counters made of an inner layer of plastic and an outer layer of leather.

The other major portion of an athletic shoe is the sole. Designed to withstand many miles of running, it must have an extremely durable bottom surface to contact the ground. The ground contact surface of an athletic shoe includes traction elements or cleats to enhance the traction between the foot and the ground. The considerable forces generated by running require that the sole of a running provide enhanced protection and shock absorption for the foot and leg. Accordingly, the sole of a running shoe typically includes several layers, including a resilient, energy-absorbent material as a midsole and a ground contacting outer sole or outsole, which provides durability, cushioning and traction. This is particularly true for a training or jogging shoe designed to be used over long distances and over a long period of time. The sole also provides a broad, stable base to support the foot during ground contact. In the design and construction of prior art outer soles for athletic shoes, traction and durability have been the primary factors given consideration. While these factors are important, other performance factors, such as light weight, flexibility, and enhanced foot dynamics also merit emphasis. Moreover, since the outer sole constitutes about $\frac{1}{3}$ of the total weight of the shoe, it is important to maximize its contribution to comfort, performance, support and protection of the foot.

The broad concept of using cleats and ridges for improved traction and comfort in a running shoe are disclosed in the prior art. For example, U.S. Pat. No. 4,364,190 issued to Ronald C. Yonkers on Dec. 21, 1982 discloses an outer sole for an athletic shoe wherein a plurality of bars extend downward from the base of the outsole in a transverse direction, and the widths of the bars are varied in proportion to the load exerted on the outsole at various longitudinal locations. The use of transverse bars enhances flexibility and provides lateral stability, while varying the width of the bars provides traction and wear resistance where necessary and keeps the weight of the outsole relatively low.

U.S. Pat. No. 4,262,435 issued to Block et al. on Apr. 21, 1981 discloses an athletic shoe wherein the sole piece has a flexure break segment of reduced thickness. The reduced thickness break segment follows and underlies the phalangal-metatarsal joint line. The reduced thickness break segment thus is formed as a single line extending across the width of the sole piece, with the line having two segments disposed at different angles with respect to a lengthwise direction of the sole. These segments join at a point intermediate the transverse width of the sole piece. The U.S. Pat. No. 4,262,435 patent states that the flexibility of the sole piece is enhanced along the length of the reduced thickness break segment. However, a resistance point is created where the two segments of the break are joined in the interior area of the sole. Thus, while the U.S. Pat. No. 4,262,435 patent recognizes the desirability of enhancing the flexibility of a sole piece to accommodate the natural motions of the foot, the particular technique disclosed in the patent does not accomplish this objective in an optimal manner.

SUMMARY OF THE INVENTION

The present invention is directed to a sole for footwear comprised of at least one layer of material which is adapted to be attached to an upper of the footwear. The at least one layer of material includes a first flex means for enhancing the flexibility of the material along a first line extending substantially parallel to a medial metatarsal-phalanges line which extends between the first and second metatarsal-phalanges joints. A second flex means is formed in the material for enhancing the flexibility of the material along a second line extending substantially parallel to a lateral metatarsal-phalanges line which extends along the second through fifth metatarsal-phalanges joints. The first and second flex means join one another at the medial edge of the sole.

In a preferred embodiment, the first flex means includes a first groove formed in the material along the first line, and the second flex means includes a second groove formed in the material along the second line. The first and second grooves extend laterally across substantially the entire width of the sole and join one another at the medial edge of the sole and approximately at the first metatarsal-phalanges joint.

The present invention can be used with numerous types of footwear. For example, when the footwear is an athletic training shoe which typically includes an outsole layer of resilient wear-resistant material and a midsole layer of shock absorbing material, the first and second grooves can be formed in either or both of the sole layers. The present invention is also particularly useful in athletic shoes which utilize relatively stiff outsoles. For example, cupsoles which are used in basketball and tennis shoes are relatively stiff and, hence, the incorporation of the first and second grooves of the present invention into the cupsole enhances the flexibility and comfort of the shoe. The enhancement of flexibility and comfort of a relatively stiff cleated shoe, such as a soccer or football shoe, also is accomplished by incorporating the first and second grooves into the outsole of such shoes.

The present invention enhances flexibility of the sole along two axes of motion, i.e., along the medial and lateral metatarsal-phalanges lines, without adding a resistance point to the sole. Also, joining the flex grooves at the medial edge of the sole aids the natural foot rolling motion from the lateral side at heelstrike to the medial side during forefoot contact. Locating the juncture of the grooves adjacent the first metatarsal-phalanges joint also concentrates maximum flexibility at the maximum flex point, which again enhances natural foot motion. Even though the proximal groove is located behind the line extending between the second through fifth metatarsal-phalanges joints, the groove enhances flexibility along this line or axis to a satisfactory degree because the fatty tissue along the ball of the foot results in a relative large radius about which the foot moves in the forefoot region.

Various advantages and features of novelty which characterize the invention are pointed out with particularity in the claims annexed hereto and forming a part hereof. However, for a better understanding of the invention, its advantages, and objects obtained by its use, reference should be made to the drawings which form a further part hereof, and to the accompanying descriptive matter, in which there are illustrated and described preferred embodiments of the invention.

DETAILED DESCRIPTION OF THE INVENTION

Figure 1:
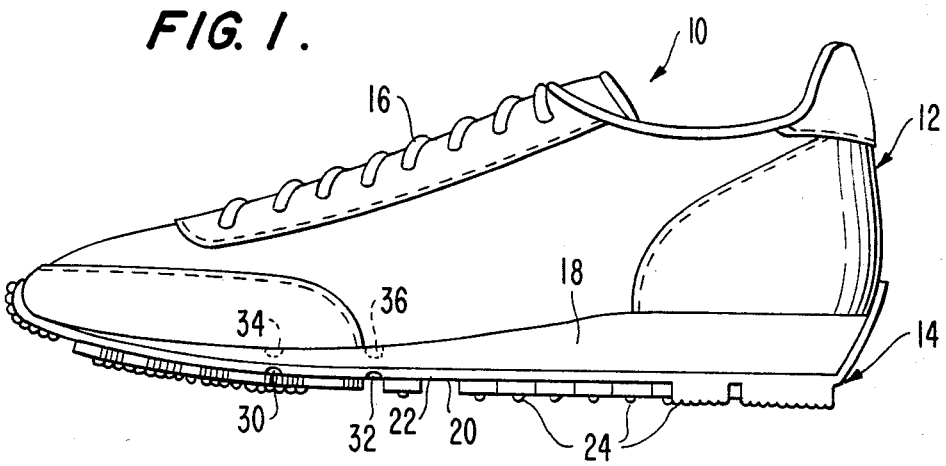
FIG. 1 is a side elevational view of an article of footwear, an athletic training or jogging shoe, in accordance with the present invention.
Figure 2:
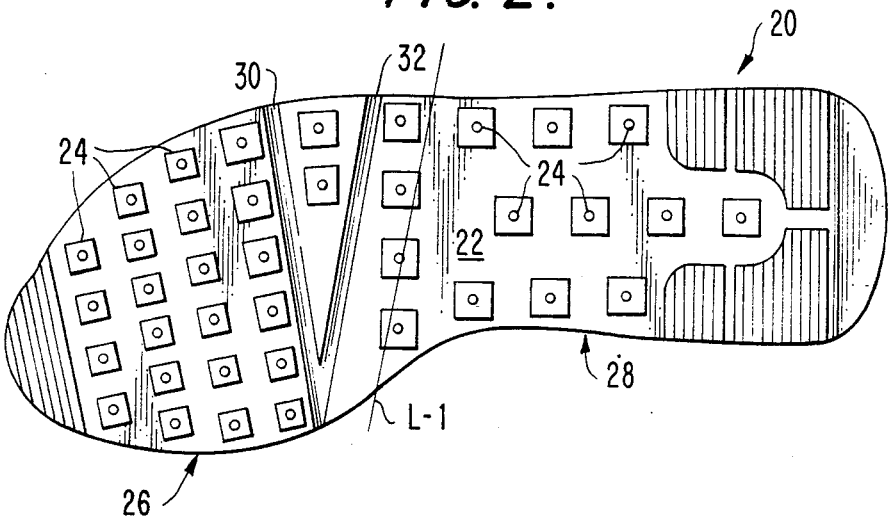
FIG. 2 is a bottom plan view of a sole of the footwear in accordance with the present invention.

Referring to the drawings, wherein like numerals indicate like elements, there is shown in FIG. 1 an article of footwear, in particular an athletic training shoe designated generally as 10. Shoe 10 includes an upper 12 and a sole 14. Upper 12 can be formed as any conventional upper, in particular an upper adapted for use in an athletic training shoe, and includes lace holes along the throat of the upper to accommodate laces 16. Sole 14 includes a midsole layer 18 and an outsole layer 20. Midsole layer 18 is formed of a conventional resilient shock absorbing material and includes a heel lift area for raising the level of the heel above the toes. Outsole layer 20 is formed of a conventional resilient wear-resistant material and includes a base 22 which extends along its entire width and length and a plurality of traction cleats or elements 24 extending integrally from base 22.

Sole 14 can be broadly divided into a forepart section 26 forward of line L-1 and a rearpart section 28 rearward of L-1. Line L-1 is intended to be diagrammatic and not to indicate a precise line of demarcation between a forepart section and a rearpart section. However, generally the forepart section includes the area of shoe 10 beneath the toe and ball of the foot of a wearer and the rearpart section includes the portion of the shoe below the arch and heel of the wearer. Base 22 having a first flexibility and a second greater flexibility.

Figure 3:
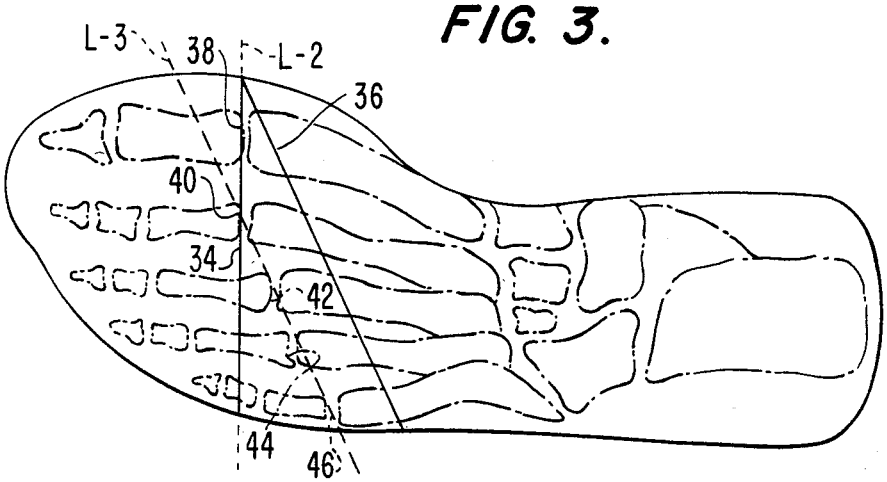
FIG. 3 is a top plan view of a midsole layer of the sole in FIG. 1, illustrating the approximate location of the bones of the foot.

A distal (closest to the toes) flex groove 30 and proximal (closest to the heel) groove 32 are formed in base 22 of outsole layer 20. Grooves 30 and 32 make up the second flexibility of the base 22 and function as weakened areas of sole 14 to enhance the flexibility of sole 14 along the lines which the grooves extend. Weakened areas of sole 14 can also be formed as flex grooves 34 and 36 in midsole layer 18, as shown in dashed line in FIG. 1 and solid line in FIG. 3. Grooves 34 and 36 may be used in addition to or in place of grooves 30 and 32. Other techniques can also be used to weaken sole 14 along the lines which the grooves extend. Distal grooves 30 and 34 are aligned and coextensive with a medial metatarsal-phalanges joint line L-2 which extends between the first and second metatarsal-phalanges joints 38 and 40. Proximal grooves 32, 36 are substantially parallel or aligned with a lateral metatarsal-phalanges joint line L-3 which extends along the second through fifth metatarsal-phalanges joints 40, 42, 44 and 46. Grooves 32 and 36, however, are located rearward on line L-3.

Each of the grooves 30, 32, 34 and 36 extends across substantially the entire width of sole 14. Grooves 30 and 34 enhance the flexibility of sole 14 along a first line of motion or action, i.e., along L-2 the medial metatarsal-phalanges joint line. Similarly, grooves 32 and 36 enhance flexibility along a second line of action, i.e., line L-3, the lateral metatarsal-phalanges joint line. It has been found that grooves 32 and 36 need not be coextensive with line L-3 to enhance the flexibility of sole 14 along such a line of action. Disposing grooves 32 and 36 slightly behind L-3 has been found satisfactory becuase of the relatively large radius about which the forefoot portion of the foot moves. In fact, by disposing grooves 32, 36 rearward of L-3, grooves 32 and 36 can join with grooves 30, 34 at the medial edge of sole 14 in an area adjacent the first metatarsal-phalanges joint 38. Grooves 30, 34 thus join with grooves 32, 36 in a generally V-shaped orientation. This orientation of the grooves places a maximum flexibility point at the area where sole 14 flexes to a maximum degree, i.e., adjacent the first metatarsal-phalanges joint 38. The V-orientation of the grooves also aids the natural roll of the foot from the lateral to the medial side during motion from heelstrike to forefoot stance by creating greater flexibility in the sole along lines which are directed to the first metatarsal-phalanges joint. The grooves 30, 34 create the second greater flexibility while the remaining portions of the sole 14 retain the first flexibility.

Figure 4:
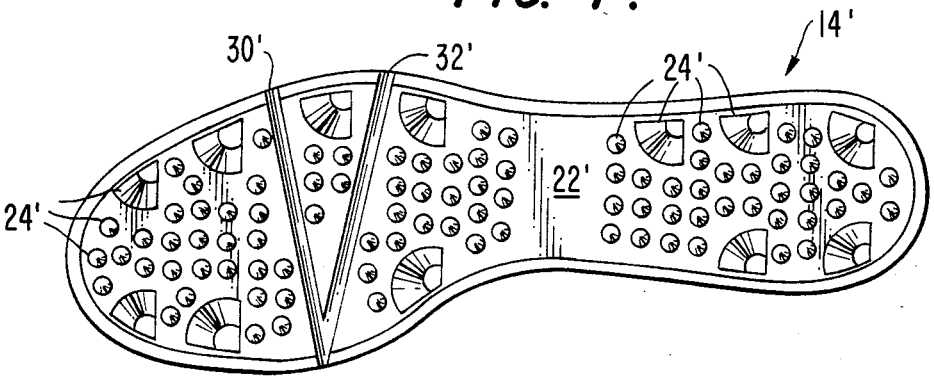
FIG. 4 is a bottom plan view of a cleated sole for use in a football or soccer shoe.
Figure 6:
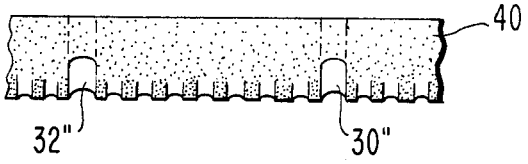
FIG. 6 is a partial side view of the cupsole of FIG. 5.

FIG. 4 illustrates another embodiment of sole 14' in accordance with the present invention. Sole 14' differs from sole 14 in that it is formed with a thicker base 22' and cleats 24' which have greater height than cleats 24. Sole 14' is particularly adapted for use in athletic shoes used in football and soccer. Additional details of sole 14' are found in U.S. Pat. No. 4,327,503 issued to Jeffrey O. Johnson on May 4, 1982. Sole 14' includes flex grooves 30' and 32' aligned in a manner similar to grooves 30 and 32.

Figure 5:
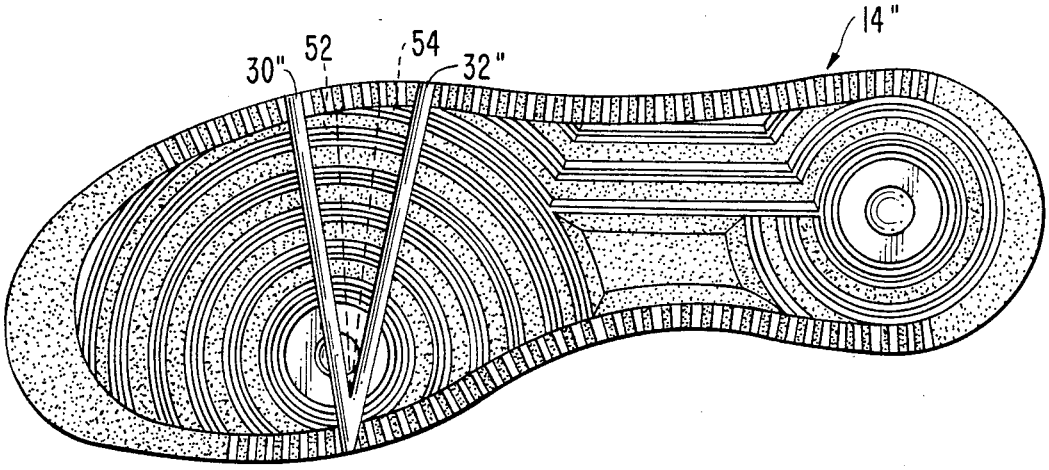
FIG. 5 is a bottom plan view of a cupsole for use in a basketball or tennis shoe.

FIG. 5 illustrates another embodiment of sole 14'' in accordance with the present invention. Sole 14'' is a cupsole which is particularly adapted for use in shoes for court sports such as basketball or shoes. Cupsoles have upstanding integral sidewalls 40 formed about part or all of their perimeter. Typical prior art cupsoles have been relatively stiff in the forepart area due to the relatively stiff material of which the cupsole is made and the integral sidewall 40 which extends about the forefoot region of the sole. The incorporation of flex grooves 30" and 32", however, enhances flexibility of the cupsole 14" in the forepart area. It is preferable to extend the grooves 30" and 32" at least partially about the sidewall of cupsole 14". FIG. 5 illustrates in dash line additional flex grooves 52 and 54 which further comprise the second greater flexibility, and, which can be used in addition to the first and second grooves, when additional flexibility is desired to thereby enhance flexibility along these additional or third grooves 52, 54. As seen in FIG. 5, additional flex grooves 52 and 54 extend across sole 14" to join with flex grooves 30" and 32" at the medial edge of sole 14" adjacent the first metatarsal-phalanges joint. The first, second and any additional grooves 30, 43, 52, 54 create the second greater flexibility while the remaining portions of the sole 14 retain the first flexibility.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size and arrangement of parts, within the principle of the invention, to the full extent indicated by the broad general meaning of the terms in which the appended claims are expressed.

We claim:

1. A sole for footwear comprising at least one layer of material adapted to be attached to an upper of the footwear, said sole having a forepart portion and a rearpart portion, said at least one layer of material having a first flexibility and a second greater flexibility for aiding the natural foot rolling motion from the lateral side at heelstrike to the medial side at forefoot stance by creating said second flexibility in the sole along lines directed toward the first metatarsal-phalanges joint, first flex means for creating the second flexibility of the material along a first line extending substantially parallel to a medial metatarsal-phalanges line which extends between the first and second metatarsal-phalanges joints and second flex means for creating the second flexibility of the material along a second line extending substantially parallel to a lateral metatarsal-phalanges line which extends along the second through fifth metatarsal-phalanges joints, said first and second lines joining one another at an area adjacent the medial side of the sole wherein said first and second flex means create said second greater flexibility while the remaining forepart portion of the sole retains said first flexibility.

2. A sole in accordance with claim 1 wherein said first flex means includes a first groove formed in said material along said first line, and said second flex means includes a second groove formed in said material along said second line.

3. A sole in accordance with claim 2 wherein each of said first and second grooves extend laterally across substantially the entire width of said sole.

4. A sole in accordance with claim 2 wherein said first groove extends along the medial metatarsal-phalanges line and said second groove is located rearward of the second through fifth metatarsal-phalanges joints.

5. A sole in accordance with claim 2 wherein said first and second grooves join one another adjacent the area of the first metatarsal-phalanges joint to concentrate flexibility caused by said first and second flex means in said last-mentioned area.

6. A sole in accordance with claim 1 wherein said first flex means includes a first weakened area formed in said material along said first line, and said second flex means includes a second weakened area formed in said material along said second line.

7. A sole in accordance with claim 6 including at least two layers of said material, one of said layers being an outsole layer, and another of said layers being a shock absorbing midsole layer, said first and second weakened areas being formed in at least one of said layers of materials.

8. Footwear comprising an upper and a sole attached to said upper, said sole having a forepart portion and a rearpart portion, said sole including at least one layer of material having a first flexibility and a second greater flexibility for aiding the natural foot rolling motion from the lateral side at heelstrike to the medial side at forefoot stance by creating said second flexibility in the sole along lines directed toward the first metartarsal-phalanges joint, a first weakened area formed in said material and extending along a first line substantially parallel to a line between the first and second metatarsal-phalanges joints to create the second flexibility of said sole along said first line, a second weakened area formed in said material along a second line substantially parallel to a line through the second through fifth metatarsal-phalanges joints to create the second flexibility of said sole along said second line, and said first and second lines joining one another at an area adjacent the medial side of said sole wherein said first and second weakened areas create said second greater flexibility while the remaining forepart portion of the sole retains said first flexibility.

9. Footwear in accordance with claim 8 wherein said first and second weakened area join one another adjacent the area of the first metatarsal-phalanges joint to concentrate flexibility caused by said first and second weakened areas in said area of the first metatarsal-phalanges joint, and said first and second weakened areas each extend across substantially the entire width of said sole.

10. Footwear in accordance with claim 8 wherein said footwear is an athletic training shoe and said at least one layer of material of said sole includes an outsole layer of resilient wear resistant material and a midsole layer of shock absorbing material, and first and second weakened areas being formed in at least one of said outsole and midsole layers of material.

11. Footwear in accordance with claim 10 wherein said first and second weakened area are formed in said outsole layer of material.

12. Footwear in accordance with claim 10 wherein said first and second weakened areas are formed in said midsole layer of material.

13. Footwear in accordance with claim 10 wherein said first and second weakened areas are formed in said outsole and midsole layers of material.

14. Footwear in accordance with claim 8 wherein said footwear is an athletic shoe and said at least one layer of sole material includes an outsole layer of material having a plurality of traction cleats formed integral therewith, and said first and second weakened areas are formed in said outsole layer of material.

15. Footwear in accordance with claim 8 wherein said footwear is an athletic shoe adapted for court play and said at least one layer of sole material includes a cupsole layer of material having a sidewall extending upward from a ground engaging portion of said cupsole around at least a portion of the perimeter of said sole.

16. Footwear in accordance with claim 15 wherein said first and second weakened areas extending upward along at least a portion of said sidewall.

17. A sole for athletic shoes comprising at least one layer of material adapted to be attached to an upper of the athletic shoe, said sole having a forepart portion and a rearpart portion, said at least one layer of material having a first flexibility and a second greater flexibility for aiding the natural foot rolling motion from the lateral side at heelstrike to the medial side at forefoot stance by creating said second flexibility in the sole along lines directed toward the first metatarsal-phalanges joint, a first groove formed in said at least one layer of material and extending substantially along a first line which passes through the first and second metatarsal-phalanges joints, a second groove formed in said at least one layer of material and extend substantially along a second line which is parallel to a line through the second to fifth metatarsal-phalanges joints, said first and second lines joining one another adjacent the area of the first metatarsal-phalanges joint, said first and second grooves creating the second flexibility of said sole along said first and second lines and concentrating the flexibility in said area of the first metatarsal-phalanges joint whereby the natural rolling motion of the foot during footstrike is accommodated and said first and second grooves create said second greater flexibility while the remaining forepart portion of the sole retains said first flexibility.

18. A sole in accordance with claim 17 wherein said at least one layer of material includes an outsole layer of resilient wear-resistant material, and said first and second grooves are formed in the bottom surface of said outsole layer and each extend across substantially the entire width of said sole.

19. A sole in accordance with claim 17 wherein said at least one layer of material includes a midsole layer of shock absorbing material and an outsole layer of resilient wear resistant material.

20. A sole in accordance with claim 19 wherein said first and second grooves are formed in said midsole layer of material.

21. A sole in accordance with claim 19 wherein said first and second grooves are formed in said outsole layer of material.

22. A sole for footwear comprising at least one layer of material adapted to be attached to an upper of the footwear, said sole having a forepart portion and a rearpart portion, said at least one layer of material having a first flexibility and a second greater flexibility for aiding the natural foot rolling motion from the lateral side at heelstrike to the medial side at forefoot stance by creating said second flexibility in the sole along lines directed toward the first metatarsal-phalanges joint, first flex means for creating the second flexibility of the material along a first line extending substantially parallel to a medial metatarsal-phalanges line which extends between the first and second metatarsal-phalanges joints, second flex means for creating the second flexibility of the material along a second line extending substantially parallel to a lateral metatarsal-phalanges line which extends along the second through fifth metatarsal-phalanges joints, third flex means for creating the second flexibility of the material along at least one additional line extending transversely of said sole, said first, second and at least one additional line joining one another at an area adjacent the medial side of the sole wherein said first, second and third flex means create said second greater flexibility while the remaining forepart portion of the sole retains said first flexibility.

23. A sole for athletic shoes comprising at least one layer of material adapted to be attached to an upper of the athletic shoe, said sole having a forepart portion and a rearpart portion, said at least one layer of material having a first flexibility and a second greater flexibility for aiding the natural foot rolling motion from the lateral side at heelstrike to the medial side at forefoot stance by creating said second flexibility in the sole along lines directed toward the first metatarsal-phalanges joint, a first groove formed in said at least one layer of material and extending substantially along a first line which passes through the first and second metatarsal-phalanges joints, a second groove formed in said at least one layer of material and extending substantially along a second line which is parallel to a line through the second to fifth metatarsal-phalanges joints, at least one additional groove formed in said at least one layer of material and extending along additional lines transversely across said sole, said first, second and each of said additional lines joining one another adjacent the area of the first metatarsal-phalanges joint, said first, second and additional grooves creating the second flexibility of said sole along said first, second and additional lines and concentrating the flexibility in said area of the first metatarsal-phalanges joint whereby the natural rolling motion of the foot during footstrike is accomodated and said first, second and additional grooves create said second greater flexibility while the remaining forepart portion of the sole retains said first flexibility.

* * * * *